United States Patent [19]

Goradesky

[11] Patent Number: 4,883,635

[45] Date of Patent: Nov. 28, 1989

[54] MEANS FOR MANUALLY HOLDING A STACK OF KARATE BOARDS

[76] Inventor: Gerald Goradesky, 17425 NE. 7th Ave., North Miami Beach, Fla. 33162

[21] Appl. No.: 199,320

[22] Filed: May 26, 1988

[51] Int. Cl.[4] ..... A63B 69/00

[52] U.S. Cl. ..... 272/76

[58] Field of Search ..... 272/76, 77, 78, DIG. 4, 272/145, 93, DIG. 30; 224/247, 250, 901; 128/77, 87 R; 248/451, 359 R, 359 G, 359 H, 359 I

[56] References Cited

U.S. PATENT DOCUMENTS

| | | | |
|---|---|---|---|
| 3,719,187 | 3/1973 | Ulansey | 128/87 R |
| 4,171,803 | 10/1979 | Smith | 272/76 |
| 4,491,316 | 1/1985 | Prince | 272/76 |
| 4,583,730 | 4/1986 | Gecht et al. | 272/76 |
| 4,732,378 | 3/1988 | LeFebure et al. | 272/76 |
| 4,757,989 | 7/1988 | Bauer | 272/76 |

*Primary Examiner*—Stephen R. Crow

[57] ABSTRACT

A device for holding a stack of one or more karate boards in any striking position comprising two physically-separate components, each component being adapted to attach around the side margins of the stack. Each component includes an elongated slat adapted to contact a side margin of the back surface of the stack and a strap attached near the other end of the slat, so as to bind each component to the stack. The slat also has handle means on its opposite side adapted to be grasped manually.

13 Claims, 1 Drawing Sheet

MEANS FOR MANUALLY HOLDING A STACK OF KARATE BOARDS

BACKGROUND OF THE INVENTION

1. Field of the Invention

This invention relates to a novel means for manually holding a stack of one or more karate boards in a striking position. The novel holding means may be used during practice sessions and during exhibitions with greater safety both to the karateka and to the persons holding the stack.

2. Description of the Prior Art

The art of karate in a form of self defense in which blows by the hands, feet and elbows are accurately delivered to vulnerable parts of the body of an attacker. As part of the training, and also at exhibitions, the karateka's strength and accuracy are developed and demonstrated by striking and breaking relatively flat karate boards by blows with the hands and feet, as described for example in Black Belt Korean Karate by D. S. Son and R. J. Clark, Prentice Hall, Inc., Englewood Cliffs, N.J., 1983, at pages 140 to 163.

The standardized karate board is a white pine wood board about 12 inches by 12 inches by 1 inch thick. The board is supported on opposite parallel sides with the wood grain running parallel to the sides that are held. Reusable karate boards; as described for example, in U.S. Pat. Nos. 4,004,799 to R. L. Kundert; 4,083,557 to R. Friedenthal; and 4,173,336 to R. W. Perry can also be used, at least for practice to reduce the costs of training.

The karate boards are held in stacks of one or more boards of equal size, shape and orientation, with or without spacers between them along the sides that are held. Ordinarily a stack of one or more boards is held along the sides of the stack by the hands of one or more persons in a striking position, whereby the karateka strikes the stack with sufficient force and accuracy to break the karate boards. Manually holding the stack of boards can result in injury to the persons holding the boards as a result of one or more factors, such as the inaccuracy of the karateka, the shattering of the boards upon being struck, fingers of the holding persons on the striking surface of the board, broken boards twisting or slipping out of the holder's grasps, etc.

Mechanical holders for a stack of karate boards that are adapted for mounting on a floor, wall or post have also been suggested; for example, in U.S. Pat. Nos. 4,173,336 to R. L. Perry and 4,295,646 to D. Squire. Such mechanical holders are limited in the positions that are practical. It is also more different to set up the stack on a mount, than by manually holding the stack. Also, such mechanical holders usually have metal parts extending in front of and/or alongside the stack that may injure the karateka should he miss the center of the stack and strike the part.

The danger of injury increases with the number of boards that are held, since greater and greater force and accuracy are required to break more and more boards. Also, the greater the number of boards that are present, the more difficult it is to keep the broken boards together just after the strike. Nevertheless, it is still preferred by karatekas to employ hand-held stacks of pine wood boards, and practical improvements for this practice are desirable.

OBJECTIONS OF THE INVENTION

An object of this invention is to provide a novel means for manually holding a stack of one or more, up to eight, karate boards.

Another object is to provide such a novel holding means which can be firmly and more easily held by the hands of the holding persons.

A further object is to provide such a novel holding means which, when manually held, reduces the danger of injury to the holding person or persons.

A still further object is to provide such a novel holding means which better holds together the stack of broken boards, just after the stack has been struck.

SUMMARY OF THE INVENTION

The foregoing and other objects are achieved with the novel means for manually holding a stack of one or more karate boards in a striking position, which boards have opposed major board surfaces, two opposite, substantially-parallel sides, and marginal areas in said major surfaces adjacent the sides of the boards. The novel manual holding means consists essentially of two physically-separate components adapted to bind together each side of the stack of boards.

Each component of the holding means includes an elongated slat having a slat surface adapted to contact one of the marginal areas in the outside surface of the stack, handle means mounted longitudually on the slat opposite the slat surface, a strap attached at its proximal end to the slat, and means for fastening the strap over the stack and to the slat, so as to hold the stack together and the slat surface against the associated marginal area. It is preferred that the two components have mirror image structures with respect to one another so that they attach symmetrically to the two marginal side areas of the stack.

In practice, one or more substantially identical boards are formed into a stack. Then, the slat of each component is placed against one and the other of the marginal areas of the end board, and the strap is passed over the stack and fastened to the slat, whereby the stack is bound by one of the components at each side of the stack to form a solidly packed mass. The stack with the novel manual holding means bound thereon is placed in any striking position for a karateka by the holding person or persons grasping the handle means and holding the stack firmly in the desired position.

The use of the handle means provides a firmer more positive hold on the stack with all of the fingers of the holding persons out of the way and protected. When the stack is broken by a strike, each of the two stacks of broken board fragments is firmly bound by one of the straps and slats and is far less likely to shatter, as frequently happens when the stack is held directly by the hands of the the holding persons. Using the novel holding means, a stack may hold as many as eight boards securely and safely, which is more than previous holders are capable. Unlike mechanical holders, there are no metal brackets or other parts that can be struck by the karateka, thereby increasing the safety for the karateka. Since the stack is manually held by the novel holding means, it can be positioned at any striking angle and can be set up more quickly than prior mechanical holders. This latter advantage is also applicable, to some extent, as compared with the prior hand-held method, since the use of handles on the novel holder deskills the holding persons to some extent.

Thus, the novel holding means is easier to set up, easier to use and safer to use than prior manual and mechanical holding methods and means. Furthermore, the use of the novel holding means is compatible with current practice and does not violate any of the current rules for training, exhibitions or competition.

DETAILED DESCRIPTION OF THE INVENTION INCLUDING THE PREFERRED EMBODIMENTS

Figure 4:
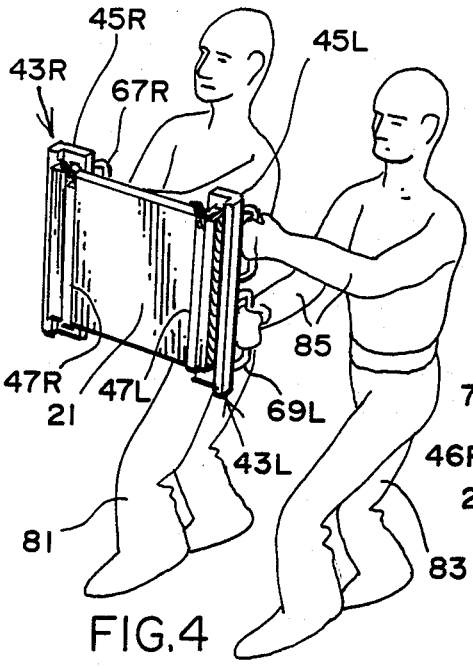
FIG. 4 is perspective view of the embodiment shown in FIG. 1 held manually in a striking position by two persons.

The following description of some of the preferred embodiments of the concept of this invention is made in reference to the accompanying figures. Where an individual structural element is depicted in more than one figure it is assigned a common reference numeral for simplification of identification and understanding.

Figure 3:
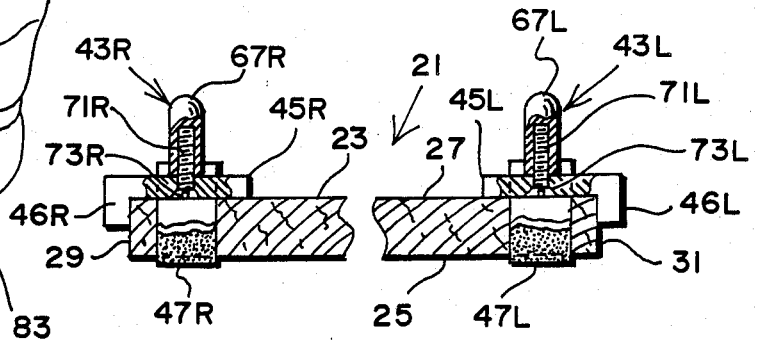
FIG. 3 is a partially broken-away end view of the embodiment shown in FIG. 1.
Figure 2:
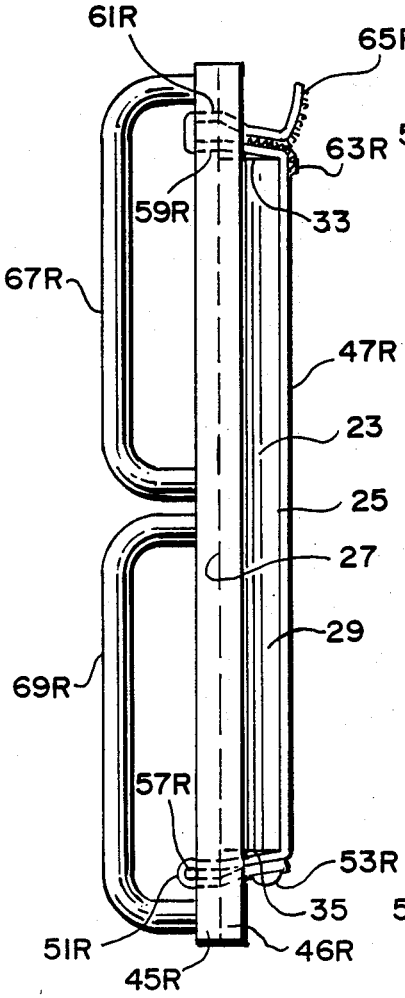
FIG. 2 is a side view of the right side of the embodiment shown in FIG. 1.
Figure 1:
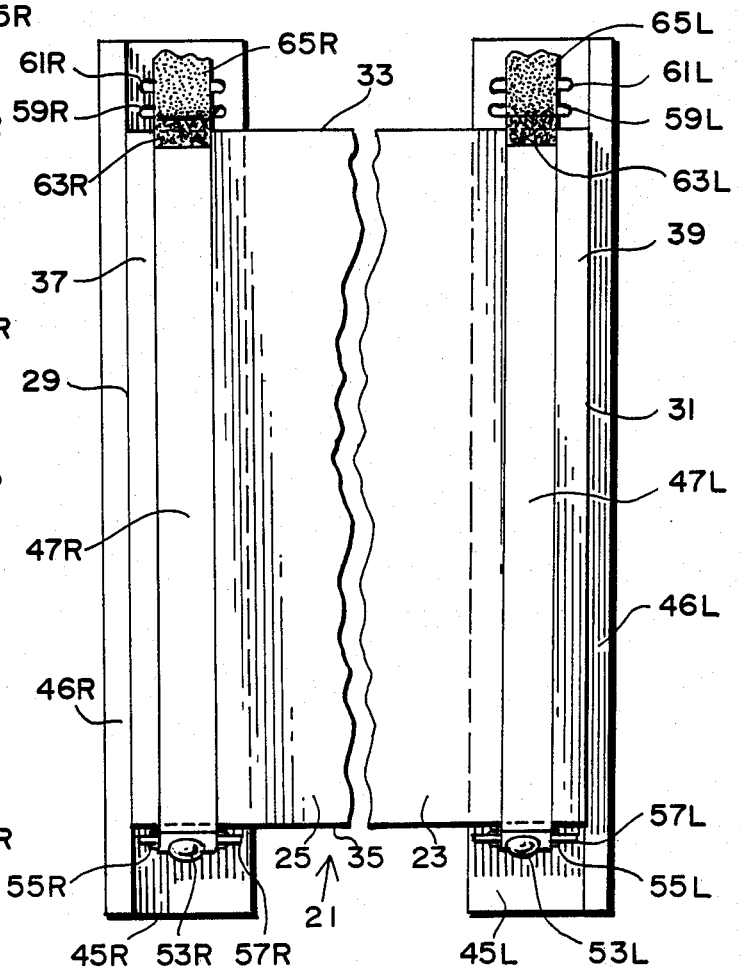
FIG. 1 is a partially broken-away front view of a preferred embodiment of the novel holding means mounted on a single standard-size pine wood karate board.

Referring to FIGS. 1, 2 and 3, there is shown a stack 21 of one board 23 of white pine wood about 12 inches by 12 inches by 1 inch thick (nominal dimensions according to lumber industry practice). The board 23 has two opposed major surfaces 25 and 27, substantially parallel right and left sides 29 and 31 respectively, and substantially parallel top and bottom ends 33 and 35 respectively. The board 23 is flat and there are right and left marginal side areas 37 and 39 (FIG. 1) each about 2½ inches wide adjacent to each side 29 and 31 over the entire length of the board 23. The grain of the wood in the board 23 runs in a direction that is substantially parallel to the sides 29 and 31, as shown by the arrows 41 (FIG. 1).

Although only one board 23 is shown in the stack 21, more than one board of substantially equal size and shape may make up the stack 21. Where more than one board is present, the boards are placed together with all major surfaces facing one another, with all the grains of the boards extending in the same direction, and all of the sides aligned with one an another, similar to the common prior practice. Where more than one board is present, the boards may have spaces there between in the side marginal areas described above, or there may be no spaces present.

The novel holding means consists essentially of a physically-separate right component 43R and a physically-separate left component 43L, which are strapped around the right marginal side areas 37 and left marginal side areas 39 respectively, as will now be described. The right and left components 43R and 43L have mirror-image structures of one another, and the structures bear the same reference numerals for similar structures followed by an R or an L to indicate that they are in the right or left component 43R and 43L respectively.

The right component 43R includes a flat right slat 45R about 15 inches long adapted to contact the entire right marginal side area 37 of the outer board surface of the stack on one side. The right slat 45R extends about 1½ inches beyond the top and bottom ends 33 and 35 respectively. There is a right lip 46R about 3/8 inch high along the outer edge of the right slat 45R to aid in positioning the right slat 45R on the board 23. The right slat 45R with or without and integral up 46R may be made of any rigid material such as a plastic, wood or metal.

The right proximal end portion of a right strap 47R is attached to the right slat 45R in the extended portion thereof near the bottom end 35 of the board 23. The right strap 47R is placed over the right marginal side portions 37 of the board 23, and the distal end portion of the right strap 47R is attached and fastened to the right slat 45R in its other extended portion near the top end 33 of the board 23, in such manner as to bind the right slat 45R to the karate board 23. If there is more than one board present in the stack, all of the boards are also bound together by the right strap 47R.

As shown in FIGS. 1 and 2, the right strap 47R is attached to the right slat 45R by forming the right proximal end portion into a right flat loop and attaching the strap end to itself with a right snap 53R. The right flat loop has a bend 51R that is passed through a transverse right lower slot 55R and is anchored there with a structural stop in the form of a right anchor pin 57R. The right distal end of the right strap 47R is passed through a transverse right middle slot 59R and then back through a transverse right upper slot 61R and then fastened to itself. As shown in FIGS. 1 and 2, the right strap 47R carries on its outer surface a hook-and-pile (VELCRO) fastener pair, specifically a right pile portion 63R and a right hook portion 65R which fasten together when they are pressed against one another. With thus or a similar structure the right strap 47R and the right slat 45R can be tightened around the right marginal side areas 37. The right strap 47R is sufficiently long to bind together more than one board, up to eight boards, in the stack 21. The right strap 47R is preferrably made of a woven plastic material, and may be springy or elastic if desired.

As shown in FIGS. 2 and 3, the right component 43R includes also a handle means comprising an upper right handle 67R and a lower right handle 69R attached longitudinally to the right slat 45R on the opposite side from the stack 21. By "longitudinally" is meant that the handles 67R and 69R are attached in the long direction of the right slat 45, so that they can be grasped from the sides. The right handles 67R and 69R are attached at each end thereof with screws 71R having heads 73R that are counter sunk into the right slat 45 so that they do not interfere with the stack 21, as shown in broken away portions of FIG. 3.

As stated above, the left component 43L has a mirror image structure of the right component 43R. The left component 43L includes a flat left slat 45L about 15 inches long adapted to contact the entire left marginal side area 39 of the outer board surface of the stack 21 on its one side. The left slot 45L extends about 1½ inches beyond the top and bottom ends 33 and 35 respectively of the board 23. There is a left lip 46L about ⅜ inch high along the outer edge of the left slat 45L to and in positioning the left slat 45L on the board 21.

The left proximal end portion of a left strap 47L is attached to the left slat 45L in the extended portion of the slat (in a manner similar to that described for the right component) employing a left flat loop having a bend 51L formed using a left snap 53L, a left lower slot 55L and a left anchor pin 57L. The left strap 47L is placed over the left marginal side portions 39 of the board 23 and the distal end portion thereof is attached and fastened to the left slat 45L in its other extended portion near the top end 33 of the board 23 in such manner as to bind the left slat 45R to the board 23, including threading the left strap 47L through a left middle slot 59L, and then back through a left upper slot 61L, and then fastening the left strap 47L to itself using a left pile portion 63L and a left hook portion 65L of a left hook-and-pile fastener pair.

FIG. 4 shows the assembled stack 21 and the novel holding means held by the right handles 67R and 69R by a first person 81, and by the left handles 67L and 69L by a second person 83. The stances of the first and second persons 81 and 83 and the angle and height of the stack 21 are the same or very similar to those used previously for manually holding a stack. Unlike previous method wherein the persons had to form a clamp with their hands around the stack, this function to performed by the slats 45R and 45L and the straps 47R and 47L. This removes all fingers from in front of and along the sides of the stack where they can be injured. Also, it eliminates the stress needed to clamp the stack using fingers to form the clamps.

The stack 21 must be kept in a firm position so that the stack will not yield when it is struck by the karateka. Previously, this was achieved by the holding persons stances as shown in FIG. 4. In addition to the stances, the holding persons place the heels of their hands firmly against the back of the stack. Placing hands in this position in addition to clamping the stack of boards puts great stress on the holders' hands This stress is substantially relieved with the novel holding means. With the novel holding means, the handles 67R, 69R, 67L and 69L are grasped, and the heels of the hands are firmly behind these handles. This is a much easier position to assume and maintain. Also, as shown in FIG. 4, the holders arms 85 are crossed in order to provide better support for the stack 21 being held.

As stated above, the stack 21 may contain one to eight boards. Where the stack has one board, one or two persons are adequate to hold the stack firmly with the novel holding means. With two to four boards, two persons as shown in FIG. 4 are necessary for the stack to be held. Where more than four boards are present in the stack, three, four or five persons are required for the stack to be held. Where several persons must be used to hold the stack, the novel holding means provides a much easier situation to set up, and more of the strength and energy of the holding persons can be translated into useful results. Of particular interest is the fact that many hands can more easily and usefully be positioned on the handles of the novel holding means as compared to those many hands grasping the stack itself.

Another feature of the novel holding means is that the wood fragments of broken boards are held together by the straps and slats when the boards are broken. By the previous manual method where the boards are held together by hands, the greater the number of boards in the stack, the more likely it is that the broken boards will twist out of the hand grasps and fly apart in many directions, with the possibility of injury to the persons present. This source of danger is essentially eliminated with the novel holding means.

Because of the many causes of possible injury, with the prior manual holding technique, holders of the stack of boards sometimes flinched just before or during the instant when the stack is struck. This reduces the firmness with which the stack is held and also introduces another source of injury. Since persons using the novel holding means are subject to less danger, they feel more secure and are less likely to flinch when using the novel holding means.

The single position with two stack holders shown in FIG. 4 is only exemplary. The stack with the novel holding means attached may be positioned at any angle and at any level previously used with the prior methods. Additional positions are also possible using the novel holding means.

The foregoing figures and descriptions thereof are provided as illustrative of some of the preferred embodiments of the concept of this invention. While these embodiments represent what is regarded as the best modes for practicing the invention, they are not intended as delineating the scope of the invention, which is set forth in the following claims.

What is claimed is:

1. Means for manually holding a stack of one or more karate boards in a striking position, each board having opposed major board surfaces, two opposite, substantially parallel sides, and marginal areas adjacent said sides, said manual holding means comprising two physically separate components adapted to be used together with said board, each said component comprising:

an elongated slat having a contact surface adapted to contact one of said marginal areas on the outside board of said stack, handle means mounted longitudinally on said slat opposite said contact surfaces, a strap having a proximal end portion attached to said slat, and means for fastening said strap around said stack and to said slat to bind said component to said stack such that said components are physically separated when in said striking position wherein said strap fastening means includes a transverse proximal slot and distal slots in each of said slats such that said straps are inserted into said slots for fastening said boards to said components.

2. The manual holding means defined in claim 1 wherein said slat includes also a lip alongside and rising above one side of said contact surface, said lip being adapted to abut the parallel side of said board that is adjacent said one marginal area.

3. The manual holding means defined in claim 1 wherein said elongated slat is substantially longer than the length of said one marginal area.

4. The manual holding means defined in claim 1 wherein said two components are structural mirror-images of one another.

5. The manual holding means defined in claim 1 wherein said handle means include two handles, each handle mounted on said slat with at least two screws having screw heads, said screw heads being recessed into said slat in said contact area.

6. The manual holding means defined in claim 1 where the proximal end portion of said strap is a flat proximal loop in said proximal slot, the bend of said loop having a structural stop therethrough, said structural stop being braced against said slat under said one of said handles, and the distal end of said strap is fastened to said strap with distal fastening means external to said distal slot and spaced from said slat.

7. The manual holding means defined in claim 6 wherein said proximal end of said strap is fastened to itself strap with a snap fastener.

8. The manual holding means defined in claim 1 wherein said strap is sufficiently long to permit the distal end thereof to be threaded through one of said distal slots towards the other of said handles, and then through the other of said distal slots away from said other handle thereby forming a flat distal loop, said strap having means for fastening to one another the portions of said strap that extend from said distal slots.

9. The manual holding means defined in claim 8 including a hook-and-pile fastener pair for fastening to one another said portions of said strap that extend from said distal slots.

10. Means for manually holding a stack of at least one karate board in a striking position, said at least one board having opposed major board surfaces, two opposite substantially parallel sides and marginal side areas in said major surfaces of said board adjacent the entire length of each of said parallel sides, said manual holding means comprising two physically separate components adapted to be used together with said stack, each of said components comprising:

an elongated slat having a slat surface adapted to contact one of said marginal ares over its entire length and to extend past said board, two handles mounted longitudinally on said slat opposite said slat surface, a strap attached at its proximal end to said slat, said strap being substantially longer than said length of said marginal area, and means for fastening said strap over said stack and to said slat to hold said slat surface closely against said one marginal area and to bind said stack such that said components are physically separated when in said striking position; wherein said strap is attached to a transverse proximal slot in said slat under one of said handles, said strap-fastening means including a pair of closely-spaced transverse distal slots in said slat under the other of said handles, said proximal slot and said distal slots being spaced apart more than the length of a parallel side of said boards, said strap being sufficiently long to pass over said stack and to form a flat proximal loop in said proximal slot and a flat distal loop through said distal slots 11. The manual holding means defined in claim 10 where said two physically-separate components are structural mirror images of one another.

12. The manual holding means defined in claim 11 wherein said elongated slat is substantially longer than the length of said parallel side of said board that is adjacent said one marginal area, and said slat has a lip upstanding along the entire outer side of said contact surface, said lip being adapted to abut the parallel side of said board that is adjacent said one marginal area.

13. The manual holding means defined in claim 10 including a structural stop through said proximal loop to prevent said proximal loop from sliding through said proximal slot, a snap fastener for fastening the ends of said proximal loop to one another, and a hook-and-pile fastener for fastening the ends of said distal loop to one another.

* * * * *